US009506230B2

(12) United States Patent
Schulte

(10) Patent No.: US 9,506,230 B2
(45) Date of Patent: Nov. 29, 2016

(54) WALL MOUNT FOR A SHOWER SYSTEM

(71) Applicant: Grohe AG, Hemer (DE)

(72) Inventor: Michael Schulte, Menden (DE)

(73) Assignee: Grohe AG, Hemer (DE)

( * ) Notice: Subject to any disclaimer, the term of this patent is extended or adjusted under 35 U.S.C. 154(b) by 140 days.

(21) Appl. No.: 13/866,595

(22) Filed: Apr. 19, 2013

(65) Prior Publication Data

US 2013/0283524 A1 Oct. 31, 2013

(30) Foreign Application Priority Data

Apr. 27, 2012 (DE) ..... 10 2012 008 406

(51) Int. Cl.
*E03C 1/042* (2006.01)
*E03C 1/06* (2006.01)
*E03C 1/04* (2006.01)

(52) U.S. Cl.
CPC ..... *E03C 1/06* (2013.01); *E03C 1/0408* (2013.01)

(58) Field of Classification Search
USPC ..... 4/695, 601
See application file for complete search history.

(56) References Cited

U.S. PATENT DOCUMENTS 3,471,872 A * 10/1969 Symmons ..... E03C 1/0408 137/118.07
3,822,826 A * 7/1974 Wilson ..... 239/267
6,438,767 B1 8/2002 Warshawsky
6,567,998 B2 * 5/2003 D'Ugo ..... 4/569
7,043,776 B1 * 5/2006 Wu ..... 4/601
2003/0056286 A1 * 3/2003 Petrovic ..... 4/601
2005/0251907 A1 * 11/2005 Mintz et al. ..... 4/695
2010/0037389 A1 2/2010 Gross

FOREIGN PATENT DOCUMENTS

DE 10 2005 004 788 A1 8/2006
DE 10 2008 039 797 A1 2/2010
JP 2005248488 A 9/2005
WO WO 2005/031073 A1 4/2005

* cited by examiner

*Primary Examiner* — Lauren Crane

(74) *Attorney, Agent, or Firm* — Muncy, Geissler, Olds & Lowe, P.C.

(57) ABSTRACT

A wall mount for a shower system at a wall connection emerging from a wall, whereby the shower system has at least one overhead shower head, a hand shower, and a shower rod. The attachment has at least one bracket with at least one conduit connected thereto and at least one adapter piece, whereby the bracket is configured to accommodate the adapter piece and a seal is provided between bracket and adapter piece, the seal allowing a relative movement between the bracket and adapter piece. The adapter piece is connectable to the wall connection by a first connecting component and the bracket is connected to the wall by a second connecting component. The bracket together with the adapter piece forms at least one conduit path between the wall connection and the conduit.

19 Claims, 5 Drawing Sheets

WALL MOUNT FOR A SHOWER SYSTEM

This nonprovisional application claims priority under 35 U.S.C. §119(a) to German Patent Application No. DE 10 2012 008 406.4, which was filed in Germany on Apr. 27, 2012, and which is herein incorporated by reference.

BACKGROUND OF THE INVENTION

Field of the Invention

The present invention relates to a wall mount for a shower system at a wall connection emerging from a wall, whereby the shower system comprises at least one overhead shower head, a hand shower, and a shower rod. Further, the present invention relates to a method for installing a shower system on a wall mount. The invention is used in sanitary facilities and here particularly in showers and baths.

Description of the Background Art

U.S. Pat. No. 7,043,776 B1 discloses a shower system with an overhead wall connection. A wall mount, which is screwed together directly with the wall connection, is provided for attaching the prior-art shower system. A disadvantage in such prior-art systems is that because of changing loads relative movements between the wall connection and the shower system can arise, which in the long run can lead to leaking at the point of connection or the wall connection itself.

SUMMARY OF THE INVENTION

It is therefore an object of the invention to solve the problems arising from the state of the art and to provide a wall mount system in particular that assures lasting reliable function and moreover is easy to assemble or disassemble.

In an embodiment of the invention, the object is attained by a wall mount, which has at least one bracket with at least one conduit connected thereto and at least one adapter piece. Further, the bracket is designed to accommodate the adapter piece and a sealing component is provided between the bracket and the adapter piece. The sealing component allows a relative movement between the bracket and adapter piece. The adapter piece is further connected to the wall connection by a first connecting component and the bracket to the wall by a second connecting component. In the assembled state, the bracket and the adapter piece form at least one conduit path between the wall connection and the conduit of the shower system. The present invention divides the connection into a mechanical connection and a technical connection to the water line by the use of an adapter piece and a bracket. Whereas the adapter piece is connected mechanically to the wall connection of the water line, it is used only to supply water to the bracket and then further to the conduit of the shower system. No forces are applied to the wall connection via the adapter piece. The bracket, in contrast, is used to absorb mechanical forces such as, for example, the weight of the shower system or other forces acting on the shower system from the outside, and to transmit them into the wall while bypassing the adapter piece. To compensate for possible relative movements between the bracket and the adapter piece, which can occur during the introduction of forces, flexible sealing components are provided between the bracket and adapter piece. The long-term leak tightness and also the mechanical strength of the shower system can therefore be greatly increased simultaneously by means of the present invention owing to the much improved wall mount.

It is provided in an embodiment of the invention that a changeover device is integrated into the bracket. Apart from the use of the wall mount of the invention at overhead wall connections, the mount can also be used for wall connections positioned below, when a changeover device is disposed there. In this case, apart from the simple conveying of water, in addition the functionality of a changeover device can be integrated into the bracket, the device, for example, providing for switching between an overhead shower head and a hand shower.

In an embodiment of the invention, two or more wall connections, adapter pieces, and conduit are provided. Whereas it is sufficient in especially simple embodiments to run mixed water lines from the wall connection through the shower system, for example, two line systems for cold and warm water can be present as a wall connection in other applications. In this case, the bracket is designed, for example, so that it has two adapter pieces for connecting two wall connections and over the further course then also two separate conduits in order to convey the incoming water streams within the shower system, for example, further to a mixer or thermostat. In this type of design as well, there would be the advantage of the invention that the mechanical load of the wall connections is eliminated and the mechanical strength of the wall mount is considerably improved.

Accordingly, it is advantageous in other refinements of the present invention if at least one flow restrictor, pressure stabilizer, temperature limiter, or pressure limiter is disposed in the adapter piece. In this way, depending on the technical and legal requirements of the particular location of the shower system, additional functionalities can already be integrated into the wall mount. This results in an especially compact design and permits an especially good configuration option.

In an embodiment of the invention, at least one top and one bottom bracket are provided, whereby the top bracket is connected to the overhead wall connection. In certain regions, overhead wall connections are installed preferentially. In this case, a shower system can be retrofitted especially easily in already existing wall connections with the wall mount of the invention and the aforementioned advantages of the present invention can be realized simultaneously.

In order to enable the desired allowable relative movement between the bracket and adapter piece, it has proven especially advantageous, moreover, if the sealing component is configured as an elastic rubber ring. In an especially simple embodiment, this can be a rubber ring with a circular profile cross section. In other embodiments, however, a plurality of rings can also be used arranged axially one behind the other. In addition, the profile of the elastic rubber ring is not limited exclusively to a circular cross section. Rather, all known cross section forms of seals can be used in relation to the present invention.

Because the demands in regard to the design forms of shower systems are subject to high requirements, it is advantageous, furthermore, if the bracket covers the adapter piece at least in the visible area. Thus, it is possible to provide only the bracket with suitably high-quality visible surfaces and to furnish the adapter piece with more reasonably priced simple surfaces, as a result of which cost savings are achieved during production.

To assure the reliable functionality of the invention, it is provided in further embodiments that a structural minimum distance or minimum gap can be provided continuously between the bracket and the adapter piece, except for the area of the sealing component. The structural minimum distance is selected, for example, so that it is greater than the deformation paths maximally allowable by the provided sealing component. The direct contact between the adapter piece and bracket and thereby a direct force transmission can be avoided in this way. Basically, it applies in the selection of the minimum distance that the greater this distance is selected, the more the force application by the bracket to the adapter piece can be reduced. If for various reasons it is necessary to select a small minimum distance, at least versus the state of the art a considerable reduction of force application can be achieved.

Finally, it is advantageous further if at least one cover is provided as a means for concealing at least the first or second connecting component. Such a cover can be formed, for example, as sheet cover and covers the connecting component such as, for example, screws by a high-quality chrome-plated surface.

In an embodiment, a first an adapter piece is attached to the wall outlet by means of a first connection component. Then, the bracket can be slipped onto the adapter piece with the sealing component disposed therebetween. In the third step, the bracket is attached to a wall by means of the second connecting component. The aforementioned steps can also be carried out in any other desired order. Thus, for example, it is possible to attach first the bracket to the wall and then to insert the adapter piece in the bracket and thereby simultaneously attach it to the wall outlet by means of the first connecting component. In this case, the sealing components are then to be configured so that sealing is achieved between bracket and adapter piece during the insertion of the adapter piece in the bracket.

In another step, both the adapter piece and the bracket are covered by a cover. The cover can be made, for example, as a metal trim or as a plastic part, which after successful attachment of the bracket and adapter piece is pushed onto these and covers both parts simultaneously.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
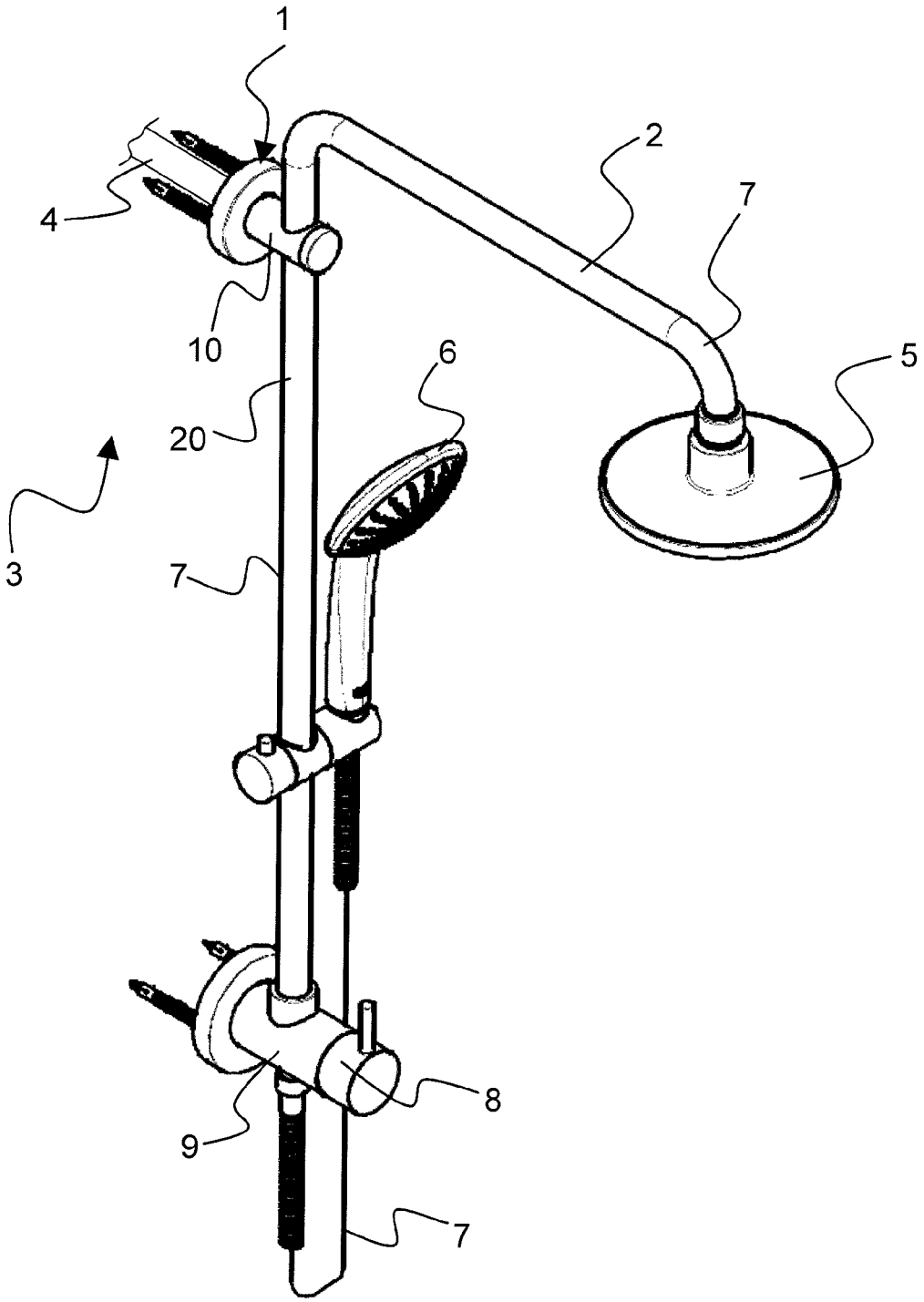
FIG. 1 is an oblique view of a wall mount of the invention for a shower system.

A wall mount 1 of the invention for a shower system 2 is illustrated in an oblique view in FIG. 1, whereby in this view shower system 2 is attached to a wall 3, from which a wall connection 4 emerges. Wall connection 4 in the shown embodiment is formed as a mixed water outlet through which water with the desired temperature is provided.

Shower system 2 comprises further a shower rod 20, an overhead shower head 5, and a hand shower 6, which are connected via a conduit 7 to a changeover device 8. Changeover device 8 is disposed in a bottom bracket 9, which for its part is connected via conduit 7 to a top bracket 10.

Figure 2:
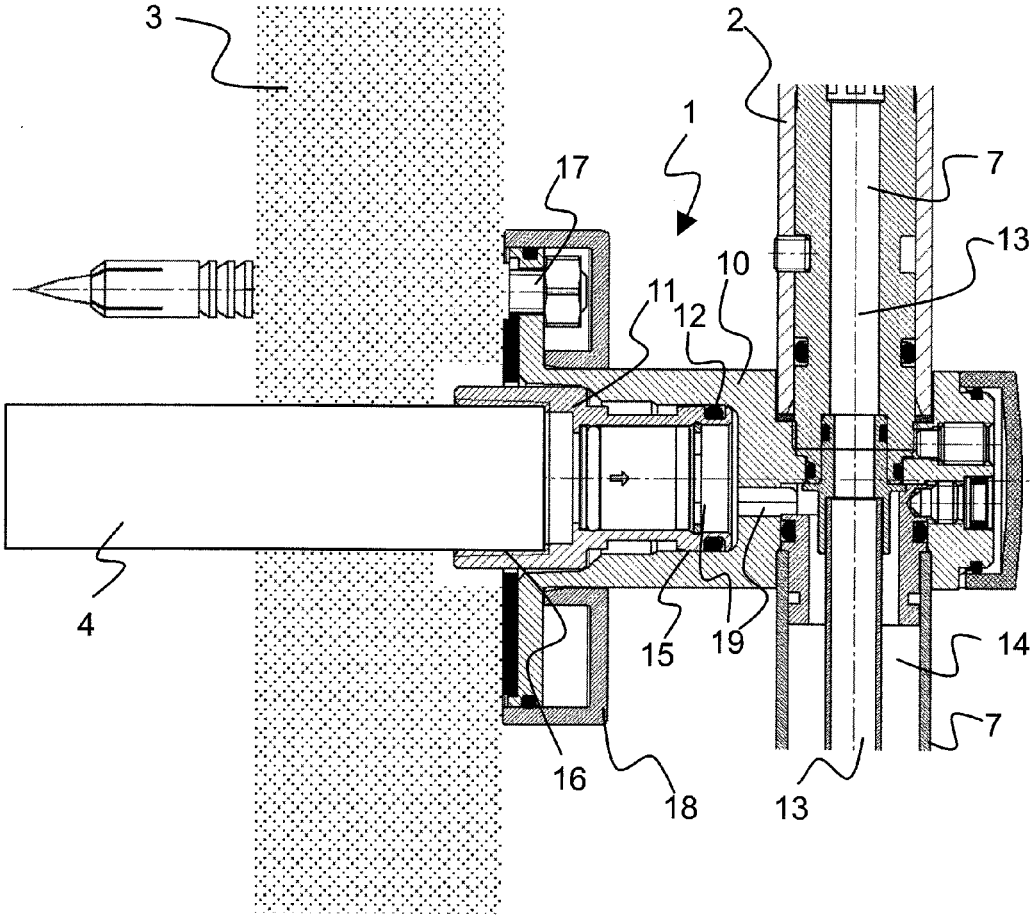
FIG. 2 is a sectional view of an assembled wall mount of the invention.

Top bracket 10 is illustrated in a sectional view in FIG. 2. The conduit 7, which conveys water alternatively to overhead shower head 5 or to hand shower 6, runs through bracket 10. In the illustrated embodiment, the conduit 7 in the top section above top bracket 10 has a first conduit channel 13, whereas in the bottom section below it comprises two separate conduit channels 13, 14. Second conduit channel 14 is used to convey water entering through bracket 10 downward to bottom bracket 9. If changeover device 8 is changed in the direction of overhead shower head 5 above, the water is then conveyed through the first conduit channel 13 upward to overhead shower head 5. Adapter piece 11, which is sealed via sealing component 12, is disposed within bracket 10. Sealing component 12 can be configured as an elastic rubber O-ring. Moreover, a minimum gap 15, which enables a relative movement between adapter piece 11 and top bracket 10, is provided between adapter piece 11 and bracket 10. In the assembled state, bracket 10 and adapter piece 11 form a conduit path 19, which connects wall connection 4 and conduit 7. Adapter piece 11 is connected for its part via a first connecting component 16 to wall connection 4. First connecting component 16 in the present case can be configured as screw thread, so that adapter piece 11 can be attached to the wall connection by simple screwing on. Bracket 10 for its part is connected to wall 3 via a second connecting component 17. Connecting component 17 is formed by a number of stud bolts with nuts that are screwed onto them. To cover second connecting component 17, moreover, a cover 18 is provided, which surrounds bracket 10 and completely covers it in the illustrated state in the area of second connecting component 17.

To assemble the shower system 2, therefore it is only necessary first to screw adapter piece 11 onto wall connection 4, then to slip bracket 10 onto this, and to connect to the wall by means of connecting component 17, in order to still slide on cover 18 in a final step. The illustrated wall mount 1 thus provides a force uncoupling of the water connection and prevents force application from shower system 2 to wall connection 4. The system moreover is especially simple to assemble.

Figure 3:
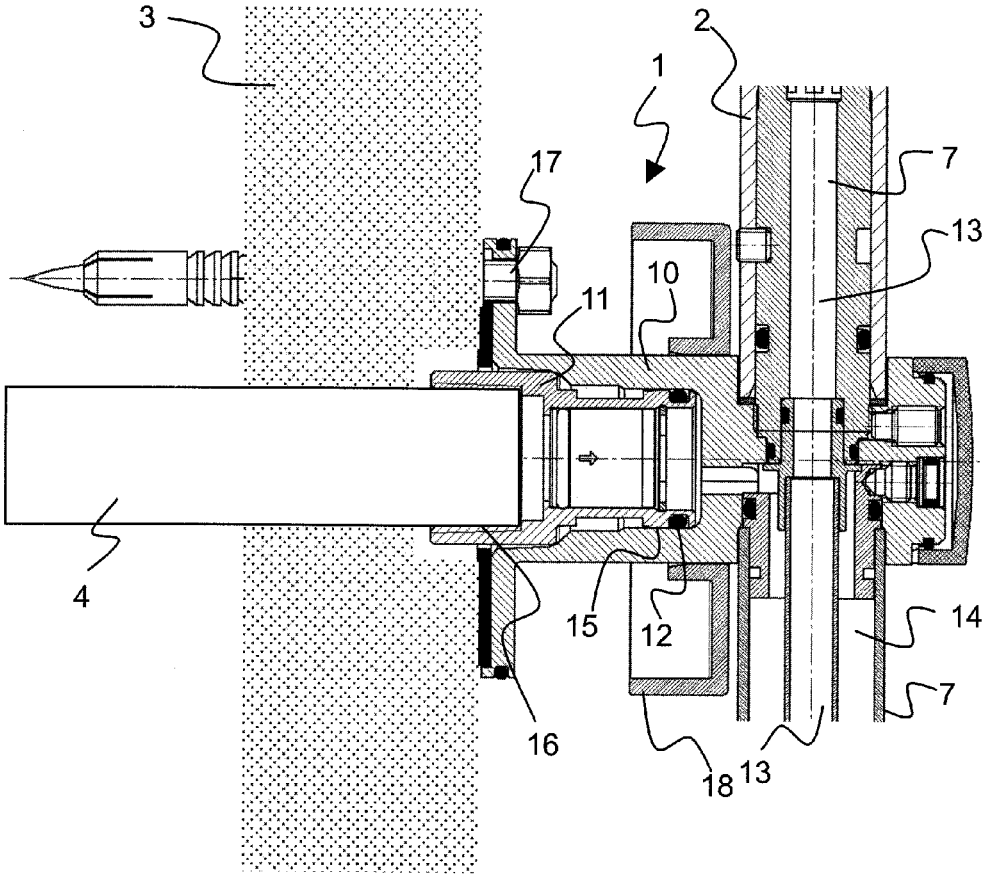
FIG. 3 is a wall mount of the invention in the first disassembly step.
Figure 4:
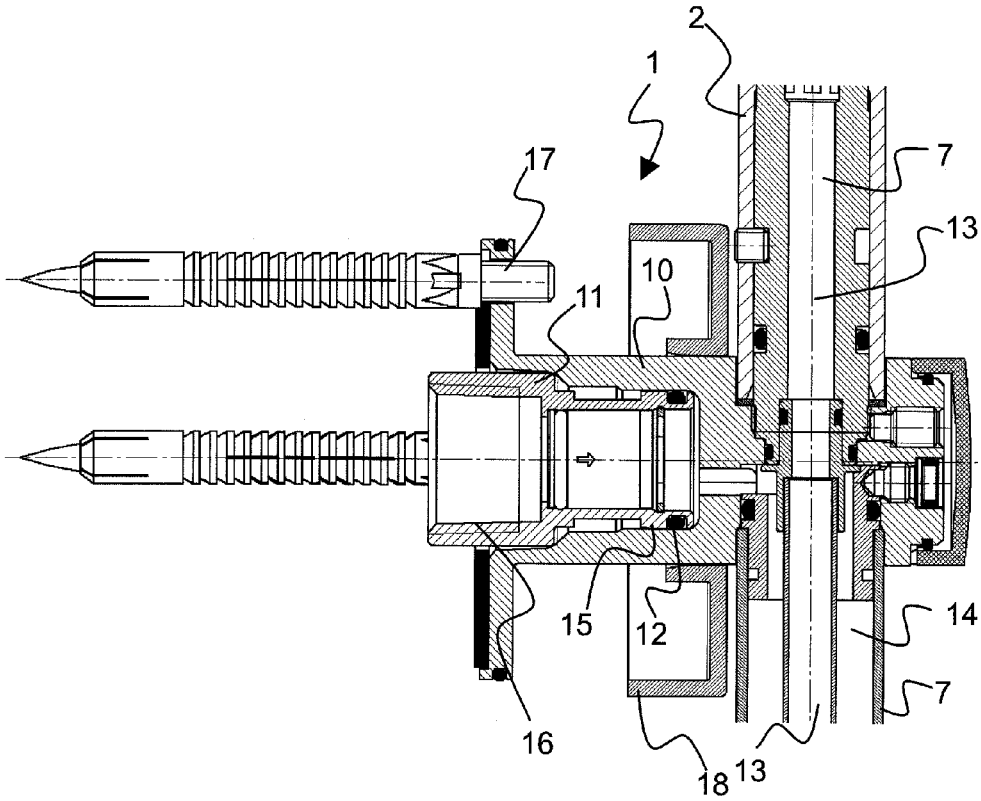
FIG. 4 is a wall mount of the invention in the second disassembly step.

Apart from the assembly, the disassembly can also occur in an especially simple manner. This is shown again simplified with the use of the following FIGS. 3 to 5. It is shown in FIG. 3 how cover 18 is pulled back for disassembly and thereby releases second connecting component 17. After the nuts of second connecting component 17 are loosened, top bracket 10 can be pulled off adapter piece 11. This state is shown in FIG. 4, after the nut of second connecting component 17 has been loosened and removed.

Figure 5:
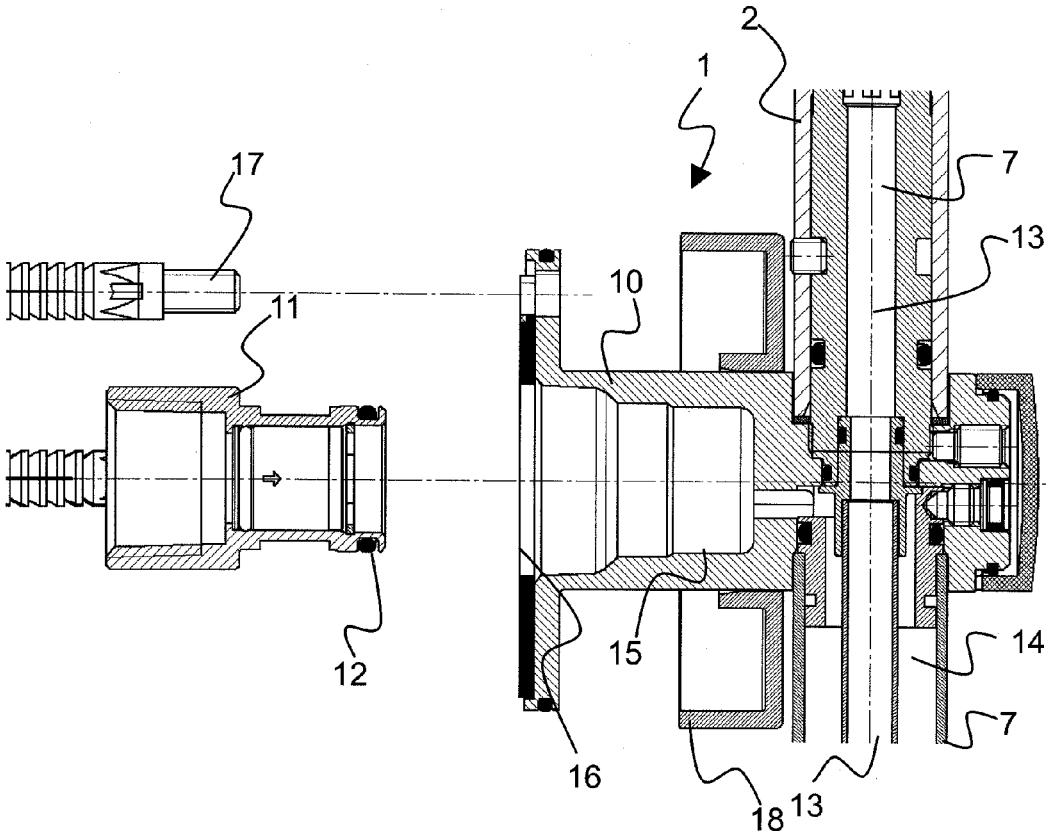
FIG. 5 is a wall mount of the invention in a fourth disassembly step.

The last step of the disassembly is shown in FIG. 5. Bracket 10 is pulled off adapter piece 11 and thus enables, for example, the maintenance of functional elements disposed within adapter piece 11 and not shown further, such as, for example, flow restrictors, pressure stabilizers, temperature limiters, or pressure limiters.

According to the above description, it should be noted that the present invention is not limited to the illustrated exemplary embodiments. Rather numerous variations of the invention within the scope of the claims are possible. Thus, for example, instead of top bracket 10 of a shower system 2, the invention can be realized also in bottom bracket 9, provided there is a wall connection 4 in the area of said bottom bracket 9. In this case, together with adapter piece 11 a changeover device 8 can be integrated into the housing of bracket 9. Further, apart from the shown use for a mixed water line, the invention can also be designed for use with separate hot and cold water lines, in that at least two adapter pieces per bracket with the associated conduit for the separate water supply are provided.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A wall mount for a shower system at a wall connection emerging from a wall, the shower system comprises at least one overhead shower head, a hand shower, and a shower rod, the wall mount comprises:

at least one bracket with at least one conduit connected thereto;

at least one adapter piece; and a seal arranged between the at least one bracket and adapter piece, the seal adapted to allow a relative movement between the at least one bracket and the adapter piece, wherein the at least one bracket is configured to accommodate the adapter piece and the seal, wherein the adapter piece is coaxial with the wall connection and is connectable to the wall connection via a first connecting component, wherein the bracket is connectable to the wall via a second connecting component, wherein the bracket together with the adapter piece forms at least one conduit path between the wall connection and the at least one conduit, wherein the bracket has a first opening into which a portion of the adapter piece and a portion of the wall connection are inserted and a second opening, the at least one conduit passing through the second opening, and wherein the first opening extends in an axial direction of the bracket and the second opening extends in a radial direction of the bracket, such that the first opening extends substantially perpendicular to the second opening.

2. The wall mount according to claim 1, wherein a changeover device is integrated into the bracket.

3. The wall mount according to claim 1, wherein two or more wall connections, adapter pieces, and conduits are provided.

4. The wall mount according to claim 1, wherein at least one flow restrictor, pressure stabilizer, temperature limiter, or pressure limiter is arranged in the adapter piece.

5. The wall mount according to claim 1, wherein at least one top and one bottom bracket are provided, and wherein the top bracket is connectable to the overhead wall connection.

6. The wall mount according to claim 1, wherein the seal is an elastic rubber ring that is provided around an exterior surface of the adapter piece.

7. The wall mount according to claim 1, wherein the bracket covers an exterior surface of the adapter piece at least in a visible area.

8. The wall mount according to claim 1, wherein a structural minimum distance is provided continuously between the bracket and the adapter piece except for the area of the seal.

9. The wall mount according to claim 1, wherein a cover is provided for concealing at least the first or second connecting components.

10. A method for assembling a shower system with a wall mount, the method comprising:

attaching an adapter piece to a wall connection via a first connecting component, the adapter piece being attached so as to be coaxial with the wall connection;

slipping a bracket onto the adapter piece, the bracket having a first opening extending in an axial direction, such that a portion of the adapter piece extends inside the first opening of the bracket;

providing a seal between the adapter piece and the bracket;

attaching the bracket to a wall via a second connecting component; and slipping a conduit through a second opening of the bracket, the second opening extending in a radial direction of the bracket, wherein, the first opening extends substantially perpendicular to the second opening.

11. The method according to claim 10, wherein at least the first or second connecting component is concealed by a cover.

12. The wall mount according to claim 1, wherein the seal and at least a portion of the adapter piece are accommodated inside the first opening of the at least one bracket.

13. The wall mount according to claim 1, wherein the conduit path is positioned between the wall connection and the at least one conduit, such that the conduit path is positioned downstream of the wall connection and upstream of the at least one conduit.

14. The wall mount according to claim 1, wherein the wall connection extends through the wall and the wall connection extends at least partially through the adapter piece.

15. The wall mount according to claim 1, wherein the bracket has a flange portion that connects to the wall via the second connecting component and a third opening, the third opening being provided in the flange portion, and wherein the second connecting component extends through the third opening in the flange portion, the third opening extending parallel to the wall connection.

16. The method according to claim 10, wherein the wall connection extends through the wall and the wall connection extends at least partially through the adapter piece.

17. The method according to claim 10, wherein the bracket has a flange portion that attaches to the wall via the second connecting component and a third opening, the third opening being provided in the flange portion, and wherein the second connecting component extends through the third opening in the flange portion, the third opening extending parallel to the wall connection.

18. A wall mount for a shower system at a wall connection emerging from a wall, the shower system comprises at least one overhead shower head, a hand shower, and a shower rod, the wall mount comprises:

at least one bracket with at least one conduit connected thereto;

at least one adapter piece; and a seal arranged between the at least one bracket and adapter piece, the seal adapted to allow a relative movement between the at least one bracket and the adapter piece, wherein the adapter piece is coaxial with the wall connection and is connectable to the wall connection via a first connecting component, wherein the bracket is connectable to the wall via a second connecting component, wherein the bracket has a first opening into which a portion of the adapter piece and a portion of the wall connection is inserted and a second opening, the at least one conduit passing through the second opening, and wherein the first opening extends in an axial direction of the bracket and the second opening extends in a radial direction of the bracket, such that the first opening extends substantially perpendicular to the second opening.

19. The wall mount according to claim 1, wherein an inner surface of the adapter piece is directly connected to an outer surface of the wall connection.

* * * * *